United States Patent [19]

Pearl

[11] Patent Number: 4,542,673

[45] Date of Patent: Sep. 24, 1985

[54] APPARATUS FOR SEALING CUT SHEET MATERIAL

[75] Inventor: David R. Pearl, West Hartford, Conn.

[73] Assignee: Gerber Garment Technology, Inc., South Windsor, Conn.

[21] Appl. No.: 627,400

[22] Filed: Jul. 3, 1984

[51] Int. Cl.[4] ..... D06H 7/00

[52] U.S. Cl. ..... 83/422; 83/925 CC

[58] Field of Search ..... 83/374, 451, 422, 925 CC; 269/21

[56] References Cited

U.S. PATENT DOCUMENTS

| | | | |
|---|---|---|---|
| 3,742,802 | 7/1973 | Maerz | 83/925 CC X |
| 4,452,113 | 6/1984 | Pearl | 83/422 |
| 4,476,756 | 10/1984 | Pearl | 83/422 |

*Primary Examiner*—James M. Meister

*Attorney, Agent, or Firm*—McCormick, Paulding & Huber

[57] ABSTRACT

An automatically controlled machine for cutting a layup of limp sheet material includes a conveyorized vacuum holddown table for advancing a layup of sheet material, compressing the layup and holding it in a fixed position while it is cut by a cutting tool supported by a cutting carriage assembly and moved by the carriage assembly in cutting relation to the layup. An overlay of air-impermeable sheet material wound on a retractable roll carried by the cutting carriage assembly is spread over the layup to cover the kerf formed in the layup by the cutting tool as the carriage assembly advances. The free end of the overlay is secured to a clamping bar at the discharge end of the table. The clamping bar is vertically movable relative to the table between raised and lowered positions.

7 Claims, 5 Drawing Figures

FIG. 2

APPARATUS FOR SEALING CUT SHEET MATERIAL

BACKGROUND OF THE INVENTION

This invention relates in general to apparatus for cutting limp sheet material and deals more particularly with improvements in cutting machines of automatic type which include a vacuum holddown system for compresing a layup of sheet material and holding it in a firmly fixed position on a support surface while a cutting instrument moves in cutting engagement with the layup in response to control signals received from a programmable controller. The vacuum holddown system may, for example, comprise a conveyorized vacuum holddown apparatus for compressing and holding successive contiguous segments of long layups to be cut which are substantially longer than the support surface. Thus, a layup or "marker" of pattern pieces used in the manufacture of garments, for example, may have overall dimensions of 6 feet (2 meters) in width and 24 feet (8 meters) or more in length. In cutting pattern pieces from such a marker, which has a length substantially greater than the length of the conveyorized cutting table, a first segment is positioned on the support surface defined by the table for cutting in a first operation. Upon completion of the first cutting operation, a second segment or bite is moved by the conveyor onto the table for cutting while the pattern pieces and scrap produced in cutting the first segment are removed.

Substantial energy is required to evacute the layup of sheet material, particularly after the material has been partially cut. Heretofore, various arrangements have been provided, in apparatus of the aforedescribed type, for paying out one or more non-destructable air-impermeable overlay sheets as the cutter moves in cutting relation to a layup, whereby to cover holes or kerfs formed in the layup by the cutting operation. One such apparatus designed to minimize leakage and loss of vacuum through cut sheet material is shown in U.S. Pat. No. 3,742,802 to Maerz, assigned to the assignee of the present invention. The apparatus disclosed by Maerz employs upon two air-impermeable overlays wound in opposite directions upon two spaced apart parallel rollers mounted on a cutting tool carriage supported for movement on and relative to a vacuum holddown table. The free ends of the overlays are secured at opposite ends of the holddown table, so that the overlay material is wound onto one of the rollers and payed-off the other of the rollers as the cutting carriage moves in a cutting mode in one and an opposite direction longitudinally of the holddown table. In this prior art, the only portion of the layup exposed during cutting is that portion below and in registry with the gap between the spaced apart rollers. The rolled overlays shown in U.S. Pat. No. 3,742,802 are not cut by the cutting tool, which is supported in the gap between the rollers, and may be repeatedly used.

A further approach to the problem is shown in U.S. Pat. No. 4,434,691 to LeBlond, also assigned to the assignee of the present invention. LeBlond provides a single non-destructable air-impermeable overlay for an automatically controlled cutting machine which includes a vacuum holddown conveyor table having an endless conveyor belt for moving successive segments of limp sheet material onto the conveyor table for cutting. The overlay comprises an elongated strip having its opposite ends wound onto rollers. One of the rollers is self-retracting and connected with the cutting carriage to pay-off or spread the overlay onto a layup of cut sheet material as the carriage moves longitudinally in one direction and retract the overlay as the cutting carriage moves in the opposite direction relative to the conveyor table during a cutting cycle. The other roller is motor driven and mounted proximate one end of the conveyor belt. An interconnecting portion of the overlay between the rollers is adapted to overlay the support surface of the conveyor table and any layup positioned thereon. As the cut layup is moved off of the cutting table, the overlay material is retrieved by the motor driven roller. At periodic intervals, portions of the overlay strip accummulated on the motor driven roller must be shifted back to the self-retracting roller mounted on the cutting carriage.

Still another arrangement for positioning a single non-destructable air-impermeable overlay in an apparatus of the aforedescribed general type is illustrated and described in my U.S. Pat. No. 4,452,113, entitled METHOD AND APPARATUS FOR SEALING CUT SHEET MATERIAL, issued June 5, 1984, and the assignee of the present invention. The apparatus disclosed in the latter patent includes a conveyorized vacuum holddown table and a sealing carriage which carries an air impermable overlay sheet wound on a self-retracting roller. The free end of the overlay sheet is mounted in fixed position proximate one end of the holddown table. The sealing carriage is supported for movement longitudially of the holddown table in coupled relation with the cutting carriage. Before the conveyor belt moves a cut segment of sheet material off of the holddown table the sealing carriage is uncoupled from the cutting carriage and the overlay is wound onto a self-retracting roller on the sealing carriage. The sealing carriage is simultaneously drawn by the overlay toward the one end of the holddown table where the sealing carriage remains parked while the cut segment is moved off the table.

While the arrangements illustrated and described in the aforementioned patents are satisfactory for most purposes, each of the aforedescribed mechanisms has some shortcomings. In some instances it may be desireable to inspect the initially cut pattern piece or pieces, as for example, during machine setup, or to remove a bundle of cut pattern pieces from the table before proceeding with the full cutting program. In the various apparatus hereinbefore described, it may be necessary to either return the tool carriage to its position of origin before the start of the cut, to enable windup of the overlay sheet, or to uncouple a sealing carriage from the tool carriage and allow it to move to a parked position in response to the self-retracting action of the roller carried by the sealing carriage, whereby to expose an initally cut pattern piece or pattern pieces. In the latter instance it is then necessary to return the cutting carriage to its positon of origin before the start of the cutting cycle, so that the sealing carriage may be coupled to it. In either instance, the cutting carriage must be moved to allow access to a partially cut layup to facilitate inspection of the initial cut, for example, before executing a complete cutting program. Such unproductive movement of the cutting carriage is time consuming and subjects the cutting apparatus to unnecessary wear.

Accordingly, it is the general aim of the present invention to provide an improved automatically controlled cutting machine wherein an air-impermeable overlay which seals material when cut is moved into overlaying relationship with an associated layup of material spread on a cutting table in response to movement of a cutting carriage during a cutting cycle and which includes means for moving the overlay either into or out of overlaying relation with a layup on the cutting table without moving the cutting carriage relative to the table.

SUMMARY OF THE INVENTION

In accordance with the present invention, an automatically controlled cutting machine for cutting layups of limp sheet material comprises a cutting table which defines a support surface on which a layup of limp sheet material is spread for cutting. The machine includes a cutting tool carriage assembly supported for movement in one and an opposite direction longitudinally of the table and carrying a cutting tool which moves with the carriage assembly to perform cutting operations on the spread sheet material in response to command signals received from a programable controller. A vacuum generating means applies vacuum at the support surface to compress a layup of sheet material positioned on the support suface and hold the material in fixed positon relative to the support surface. A retractable roll of air-impermeable overlay material is mounted on the cutting tool carriage assembly with its axis extending transversely of the table for movement with the carriage assembly. A securing means holds the free end of the overlay material in fixed position near one end of the table. The machine also includes means for supporting the securing means for movement between a lowered position wherein the free end is disposed within a plane proximate the plane of the support surface and an elevated position wherein the securing means is spaced a substantial distance above the plane of the support surface, and means for moving the securing means to and selectively maintaining the securing means in either its raised or its lowered position.

DETAILED DESCRIPTION OF PREFERRED EMBODIMENT

Figure 1:
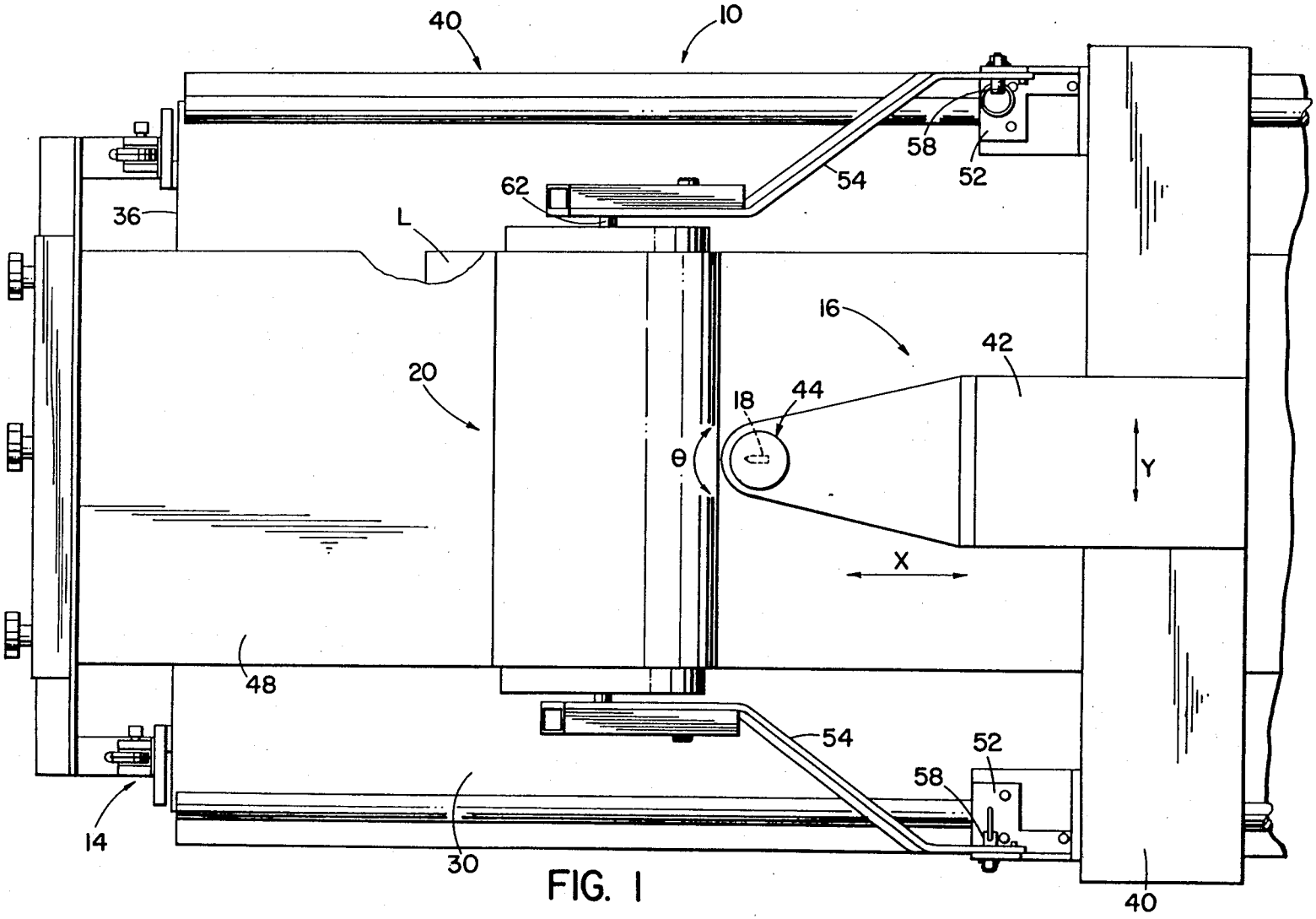
FIG. 1 is a fragmentary plan view of an automatically controlled cutting machine embodying the present invention.

Turning now to the drawings, an automatically controlled cutting machine embodying the present invention is designated generally by the numeral 10. The machine 10 is particularly adapted to cut pattern pieces from a multi-ply layup of limp sheet material, designated by the letter L, which comprises a plurality of individual sheets of material arranged in vertically stacked relationship. The sheet material may comprise woven or non-woven fabric, for example, from which pattern pieces in a variety of sizes and shapes may be cut. The pattern pieces are preferably layed out on the layup in an array or "marker" for most economical utilization of the material. Pattern pieces produced by the machine 10 may, for example, be used in the manufacture of garments or upholstery.

The layup may be formed by simultaneously withdrawing a plurality of sheets from a corresponding number of bolts of material. In the present instance, however, the layup L is formed by a cloth spreader (not shown) supported on a spreading table 12 positioned adjacent the loading end of the cutting machine 10.

The cutting machine 10 is essentially comprises a conveyorized vacuum holddown table 14 for compressing at least a segment of a layup, such as the illustrated layup indicated by the letter L, and for holding it in firmly fixed position while it is cut, and a cutting tool cariage assembly indicated generally at 16, which move a cutting tool 18 in cutting engagement with a layup such as the layup L. The machine further includes a sealing apparatus, designated generaly by the numeral 20, for covering the cut or kerf formed in the layup L by the cutting tool 18 as it moves in cutting engagement with the layup in response to signals received by the machine 10 from a programmable controller, illustrated schematically and indicated generally by the reference numeral 22.

The illustrated conveyorized vacuum holddown table 14 is of considerable longitudinal extent and is particularly adapted for moving successive segments of a layup, such as the layup L, which has a length substantially greater than the length of the table, onto the table for cutting and off the table after cutting. It includes a motor driven endless conveyor belt 24 formed by a plurality of articulated grid plates 26, 26. The air permeable conveyor belt 24 further includes bristle blocks 28, 28 mounted on the grid plates 26, 26. Each bristle block has a perforated base and a multiplicity of bristles which project from the base. The bristle blocks 28, 28 cooperate to form an airpermeable bristle mat which has an upwardly facing material supporting surface 30 defined by the free ends of the upwardly extending bristles which comprise the upper run of the conveyor 24. The opposite ends of the conveyor are supported by pairs of sprockets or star wheels 32, 32 (one shown in FIG. 2). The star wheels 32, 32 at the discharge end of the conveyor are driven by a conveyor drive motor 34. The conveyor belt 24 is mounted within a substantially airtight enclosure 36, which forms a part of the table 14. The enclosure 36 effectively forms a vacuum chamber and is evacuated by a vacuum pump, illustrated schematically at 38 and connected to the enclosure 36 by a suitable conduit which communicates with the interior of the enclosure.

The illustrated conveyor table assembly 14 may comprise a zoned vacuum holddown conveyor table assembly or System 91 Bite Feed Conveyor System, manufactured and marketed by Gerber Garment Technology, Inc., subsidiary of Gerber Scientific, Inc., South Windsor, Conn. A further disclosures of a vacuum holddown tables suitable for use in practicing the present invention are illustrated and described in U.S. Pat. No. 4,391,170 to Boverman et al, issued July 5, 1983, assigned to the assignee of the present invention and in the various patents mentioned in the introduction to this specification which are hereby adopted by reference as part of the present disclosure.

The cutting tool carriage assembly 16 has an X-carriage or beam 40 which spans the width of the table assembly 14. The beam is supported to move longitudinally of the table assembly 14 in one and an opposite longitudinal (X) coordinate direction and is driven by a motor (not shown) which receives signals from the programmable controller 22. A Y-carriage 42, mounted on the beam 40 to move relative to the beam, carries a cutting mechanism indicated generally 44, which includes the cutting tool or blade 18. More specifically, the Y-carriage 42 is supported to move in one and an opposite transverse (Y) coordinate direction on the beam 40 and relative to the cutting table assembly 14. Another drive motor (not shown) mounted on the X-carriage 40 rotates a lead screw (not shown) in either clockwise or counterclockwise direction in response to signals received from the controller 22 to drive the Y-carriage 42 in one or the other Y coordinate direction. The cutting mechanism 44 is constructed and arranged to move the cutting tool 18 in vertical or (Z) coordinate directions in response to signals from the controller 22. The illustrated cutting tool 18 comprises an elongated blade which reciprocates with a vertical cutting stroke and which is further arranged to rotate in either direction about its vertical axis, as indicated by the coordinate ($\theta$) as indicated in FIG. 1, in response to signals from the controller 22. Thus, the blade 18 is supported for compound movement in X, Y and $\theta$ coordinate directions relative to the material support surface 30 in engagement with the layup L and for movement in the Z coordinate direction into and out of cutting engagement with the layup in response to command signals received from the controller 22. For a more detailed disclosure of a tool carriage assembly as hereinbefore described, reference may be had to the aforementioned patent to Boverman et al. and the other patents hereinbefore adopted by reference as part of this disclosure.

The illustrated sealing apparatus 20 comprises a retractable roll 46 upon which there is wound a sheet of air-impermeable overlay material 48. A securing device or clamping bar 50 supported at the discharge end of the table 14 holds the free end portion of the overlay material 48 in fixed position near the discharge end of the support surface 30 as will be hereinafter further described.

Figure 2:
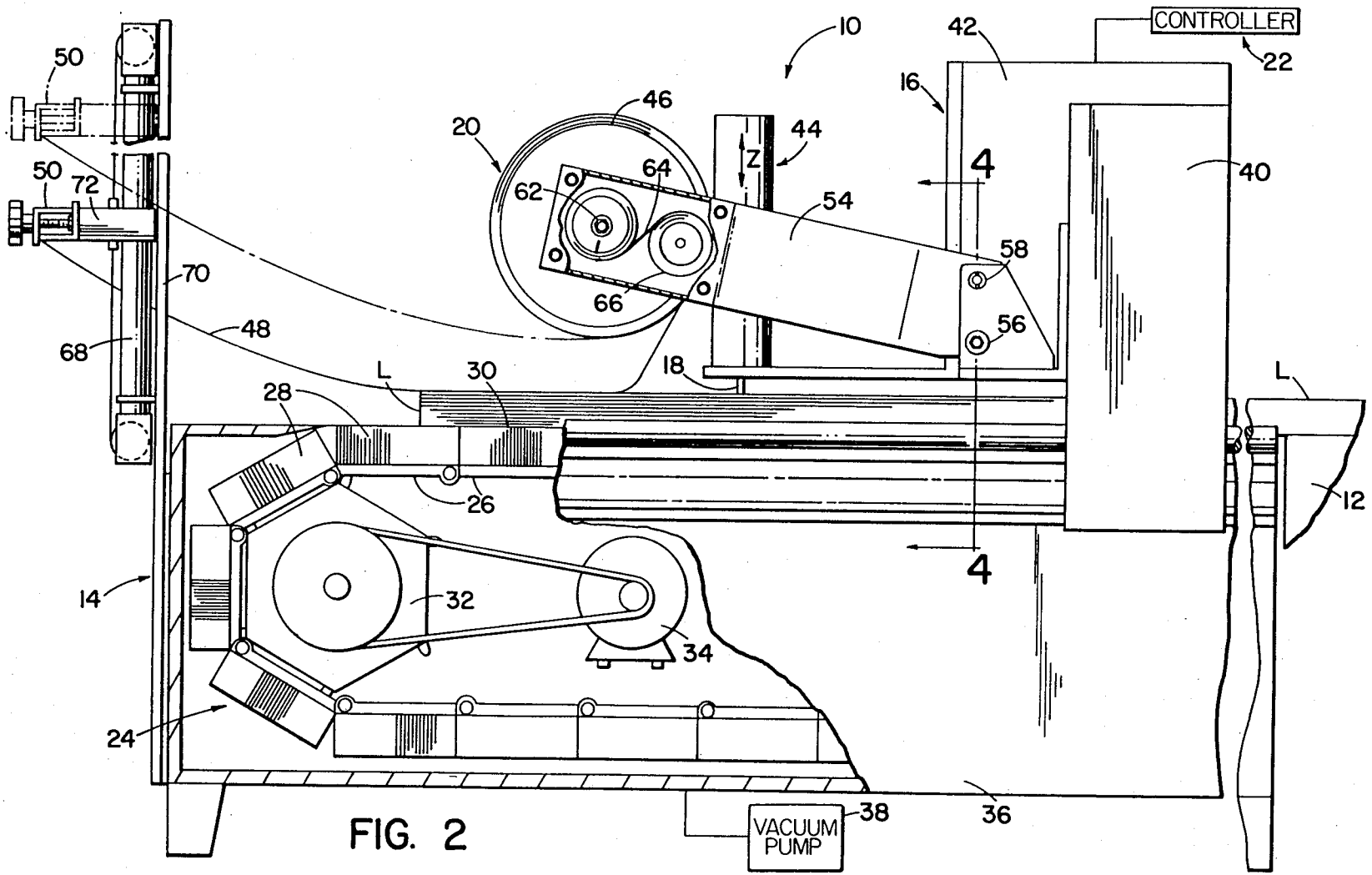
FIG. 2 is a fragmentary side elevational view of the machine of FIG. 1.
Figure 4:
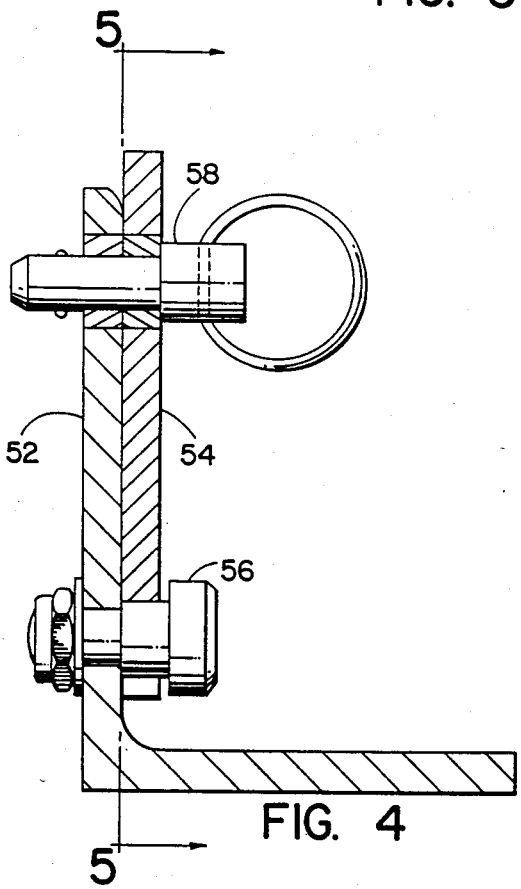
FIG. 4 is a somewhat enlarged fragmentary sectional view taken along the line 4—4 of FIG. 2.
Figure 5:
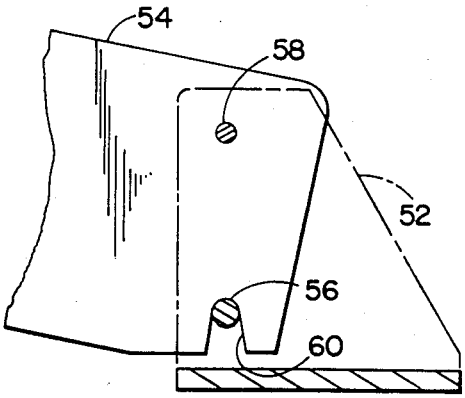
FIG. 5 is a somewhat reduced sectional view taken along the line 5—5 of FIG. 4.

Considering the apparatus 18 in further detail, the roll 46 is supported on the tool carriage assembly 16 for rotation about an axis extending transversely of the support surface 30, as best shown in FIGS. 1 and 2. Support for the roll 46 is provided by a pair of mounting brackets 52, 52 fastened in fixed position to the beam 40 at opposite sides of the support surface 30. A pair of outriggers 54, 54 are releasably secured to the brackets 52, 52 by studs 56, 56 and quick release pins 58, 58, best shown in FIGS. 4 and 5. Each outrigger 54 has a downwardly opening notch 60 at its inner end for receiving an associated stud 56 bolted in fixed position to an associated bracket 52. Each outrigger is further secured to an associated bracket 52 by a quick release pin 58 which extends through the outrigger and the associated bracket 52 as best shown in FIGS. 4 and 5. The roll 46 is supported at the outer ends of the outriggers 54, 54 by a shaft 62 which is keyed or otherwise secured in fixed position to the roll 46. The retractable roll 46 is biased in a wind-up or counterclockwise direction, as it appears in FIG. 2, by a pair of spring mechanisms (one shown in FIG. 2) mounted at the outer ends of the outriggers 54, 54 and connected to the outboard ends of the shaft 62. The windup mechanisms include N'agetor Springs 64, 64. Each spring 64 is anchored at one end to the shaft 62, coiled in one direction about the shaft, anchored at its other end to a reel 66, and coiled in an opposite direction about the reel. The springs 64, 64 are of a type well known in the art which exert a substantially constant wind-up force on the roll 46 to wind the layup 48 thereon with a constant force as the tool carriage assembly 16 moves in the direction of the discharge end of the table 14 or toward the left, as shown in FIG. 2.

Figure 3:
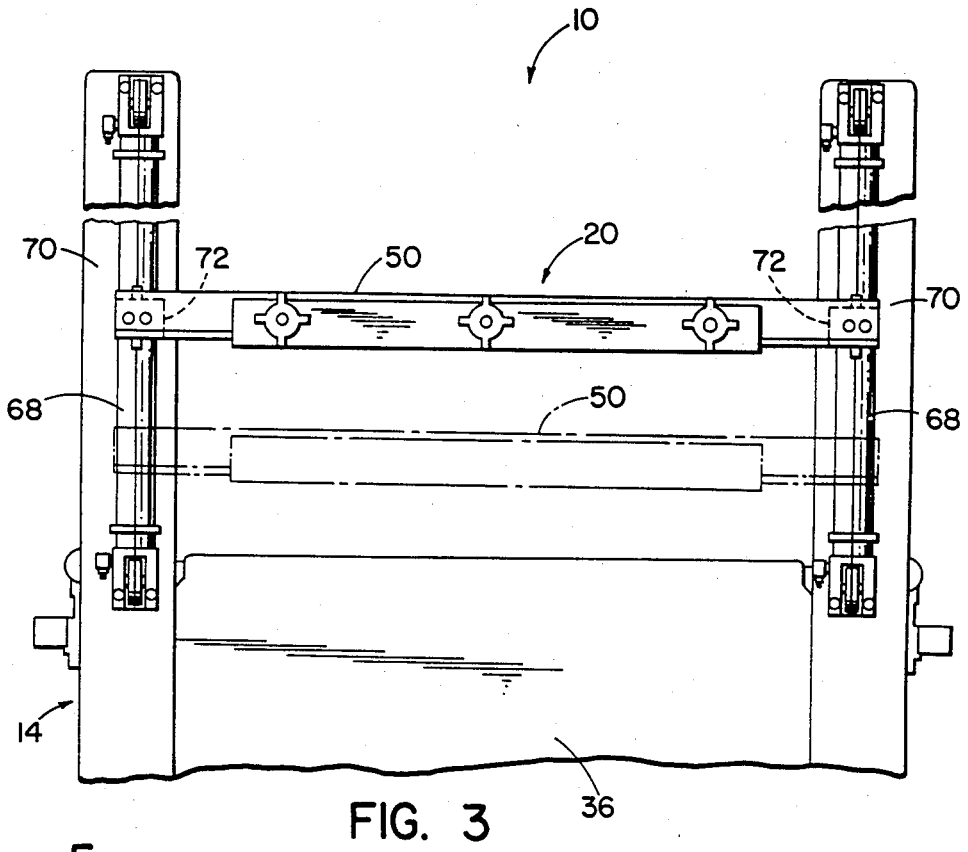
FIG. 3 is a fragmentary left end elevational view of the machine shown in FIGS. 1 and 2.

The clamping bar 50 is supported at the discharge end of the conveyor table assembly 14 for vertical sliding movement by a pair of fluid motors or cable cylinders 68, 68 mounted in axially vertical position on a pair of upright or vertically extending support members 70, 70 secured to opposite sides of the table assembly 14 at its discharge end. More specifically, the clamping bar 50 is carried by a pair of slide blocks 72, 72. Each slide block is slidably supported on the cylindrical body of an associated cable cylinder 68. The cables associated with the cable cylinders are connected to the slide blocks 72, 72, as best shown in FIGS. 2 and 3. The cylinders 68, 68 are connected to each other through fluid lines and receive fluid from a common source to operate in unison to move the clamping bar 50 between a lowered or broken line position of FIG. 3 position wherein the overlay material 48 is disposed within a generally horizontal plane in reasonably close proximity to the support surface 30 and to an elevated position indicated by broken lines in FIG. 2 wherein the free end of the overlay material 48 is located at substantial distance above the support surface 30.

Preparatory to starting the cutting cycle, vacuum is applied to the enclosure 36 by the vacuum pump 38. The initial rush of air through the layup and the surface 30 caused by application of vacuum to the chamber defined by the enclosure 36 causes the overlay material 48 above the layup L to be drawn downwardly into engagement with the upper surface of the layup whereby to compress the layup and hold it in firmly fixed position relative to the material support surface defined by the upper run of the conveyor 24. During the material cutting cycle, the conveyor 24 remains at rest and the tool carriage assembly 16 advances in the direction of the layup table 12 with the cutting tool 18 moving in cutting engagement with the layup. As the cutting tool carriage 16 advances, overlay material 48 is drawn downwardly by applied vacuum from the roll 46 and into engagement with the upper surface of the layup to cover the cut or kerf formed in the layup by the cutting tool 18.

If it should be desirable or necessary to inspect the pattern pieces initially cut from the layup at the discharge end of the layup, the vacuum holddown force at the material support surface 30 may be released and the clamping bar 50 moved to its elevated position whereby to move the overlay material 48 out of engagement with the layup near the discharge end of the conveyor to provide access to the cut pattern pieces and without moving the cutting tool carriage 16. The clamping bar 50 may also be elevated to aid in stripping the overlay material from the layup as, for example, when next successive segment of the layup is to be advanced by the conveyor 24.

I claim:

1. An automatically controlled cutting machine for cutting layups of limp sheet material comprising a cutting table defining a support surface on which a layup of limp sheet material is spread for cutting, vacuum generating means for producing vacuum at said support surface to compress the layup and hold it in firmly fixed position on the support surface, a tool carriage supported for movement in one and an opposite direction longitudinally of said cutting table, a cutting instrument supported on the tool carriage for movement with the carriage in cutting engagement with a layup spread on the support surface, a retractable roll of air-impermeable overlay material, means for supporting said roll on said tool carriage with the axis of said roll extending transversely of said support surface for movement with said tool carriage and relative to said support surface, securing means for holding the free end portion of said overlay material in fixed position near one end of said support surface, means supporting said securing means for movement between a lowered position wherein said free end is disposed proximate the plane of said support surface and an elevated position wherein said securing means is disposed a substantial distance above the plane of said support surface, and means for moving said securing means to and selectively maintaining said securing means in its lowered position and in its elevated position.

2. An automatically controlled cutting machine for cutting layups of limp sheet material as set forth in claim 1 wherein said securing means comprises a clamping member extending transversely of said support surface.

3. An automatically controlled cutting machine for cutting layups of limp sheet material as set forth in claim 2 wherein said supporting means comprises a pair of upright members disposed at opposite sides of said support surface for supporting opposite ends of said clamping member.

4. An automatically controlled cutting machine for cutting layups of limp sheet material as set forth in claim 2 wherein said means for moving said securing means comprises a cable cylinder.

5. An automatically controlled cutting machine for cutting layups of limp sheet material as set forth in claim 1 wherein said cutting table comprises a conveyorized vacuum holddown table including an endless belt conveyor having an air permeable surface defining said support surface.

6. An automatically controlled cutting machine for cutting layups of limp sheet material as set forth in claim 5 wherein said retractable roll comprises a generally cylindrical roll supported for coaxial rotation on said roll supporting means, a sheet of air-impermeable overlay material wound on said roll, and means for applying substantially uniform biasing force to said roll to wind said sheet material thereon.

7. An automatically controlled cutting machine for cutting layups of limp sheet material as set forth in claim 1 including means for releasably securing said roll supporting means on said tool carriage.

* * * * *